US006973725B2

(12) United States Patent
Lai

(10) Patent No.: US 6,973,725 B2
(45) Date of Patent: Dec. 13, 2005

(54) SCISSORS ASSEMBLY

(76) Inventor: Wei Chih Lai, No. 647, Duagguang Yuan Rd., Dung Chiu Taichung (TW) 401

( * ) Notice: Subject to any disclaimer, the term of this patent is extended or adjusted under 35 U.S.C. 154(b) by 60 days.

(21) Appl. No.: 10/358,289

(22) Filed: Feb. 5, 2003

(65) Prior Publication Data

US 2004/0148782 A1 Aug. 5, 2004

(51) Int. Cl.[7] ..... B26B 17/00

(52) U.S. Cl. ..... 30/179; 30/233

(58) Field of Search ..... 30/179, 233, 124, 30/131, 175, 178, 145

(56) References Cited

U.S. PATENT DOCUMENTS

| | | | | |
|---|---|---|---|---|
| 2,465,168 A * | 3/1949 | Monsch | 30/179 |
| 2,905,198 A * | 9/1959 | Peeps et al. | 137/627.5 |
| 5,542,182 A * | 8/1996 | Martinez | 30/179 |
| 6,595,093 B1 * | 7/2003 | Artigas | 83/468.3 |

* cited by examiner

*Primary Examiner*—Allan N. Shoap
*Assistant Examiner*—Isaac N Hamilton
(74) *Attorney, Agent, or Firm*—Alan D. Kamrath; Nikolai & Mersereau, P.A.

(57) ABSTRACT

A scissors assembly includes a main body, a jaw plate, and an angle adjusting base. Thus, the scissors assembly has a simplified construction and can be positioned efficiently. In addition, the scissors assembly can adjust the cutting angle easily and conveniently. Further, the scissors assembly is operated easily and conveniently.

20 Claims, 7 Drawing Sheets

SCISSORS ASSEMBLY

BACKGROUND OF THE INVENTION

1. Field of the Invention

The present invention relates to a scissors assembly, and more particularly to a scissors assembly that can adjust the cutting angle easily and conveniently.

2. Description of the Related Art

A conventional scissors assembly in accordance with the prior art comprises a main body, a jaw plate, an angle adjusting base, a plurality of riveting members and a plurality of locking members. The main body includes a support arm and a cutting blade pivotally mounted on the support arm. The jaw plate is secured on the support arm of the main body. The angle adjusting base is pivotally mounted on the jaw plate, so as to adjust the relative angle between the angle adjusting base and the cutting blade of the main body. Thus, the conventional scissors assembly can be used to cut a sheet shaped material, such as a wooden plate, with a determined angle by adjusting the relative angle between the angle adjusting base and the cutting blade of the main body.

However, the conventional scissors assembly has a complicated structure, thereby causing inconvenience and increasing costs in fabrication. In addition, after adjustment of the angle adjusting base, the angle adjusting base partially covers the angle scale lines on the jaw plate, so that the user easily misunderstands the angle, thereby causing inconvenience in operation. Further, the angle adjusting base cannot be adjusted and positioned on the jaw plate easily and conveniently.

SUMMARY OF THE INVENTION

The present invention mitigates and/or obviates the disadvantage of the conventional scissors assembly.

The primary objective of the present invention is to provide a scissors assembly that can be positioned efficiently.

Another objective of the present invention is to provide a scissors assembly that has a simplified construction.

A further objective of the present invention is to provide a scissors assembly that can adjust the cutting angle easily and conveniently.

A further objective of the present invention is to provide a scissors assembly that is operated easily and conveniently.

In accordance with the present invention, there is provided a scissors assembly, comprising a main body, a jaw plate, and an angle adjusting base, wherein:

the main body includes a support arm and a cutting blade pivotally mounted on the support arm;

the jaw plate is secured on the support arm of the main body and has a periphery formed with a plurality of angle scale lines and a plurality of positioning holes each aligning with a respective one of the angle scale lines; and the angle adjusting base is pivotally mounted on the jaw plate and has two sides each provided with an alignment plate aligning with either one of the angle scale lines, the alignment plate of each of the two sides of the angle adjusting base is formed with a screw bore for screwing a hollow adjusting screw containing an elastic member and a positioning ball, the positioning ball is positioned in either one of the positioning holes of the jaw plate.

Further benefits and advantages of the present invention will become apparent after a careful reading of the detailed description with appropriate reference to the accompanying drawings.

DETAILED DESCRIPTION OF THE INVENTION

Figure 1:
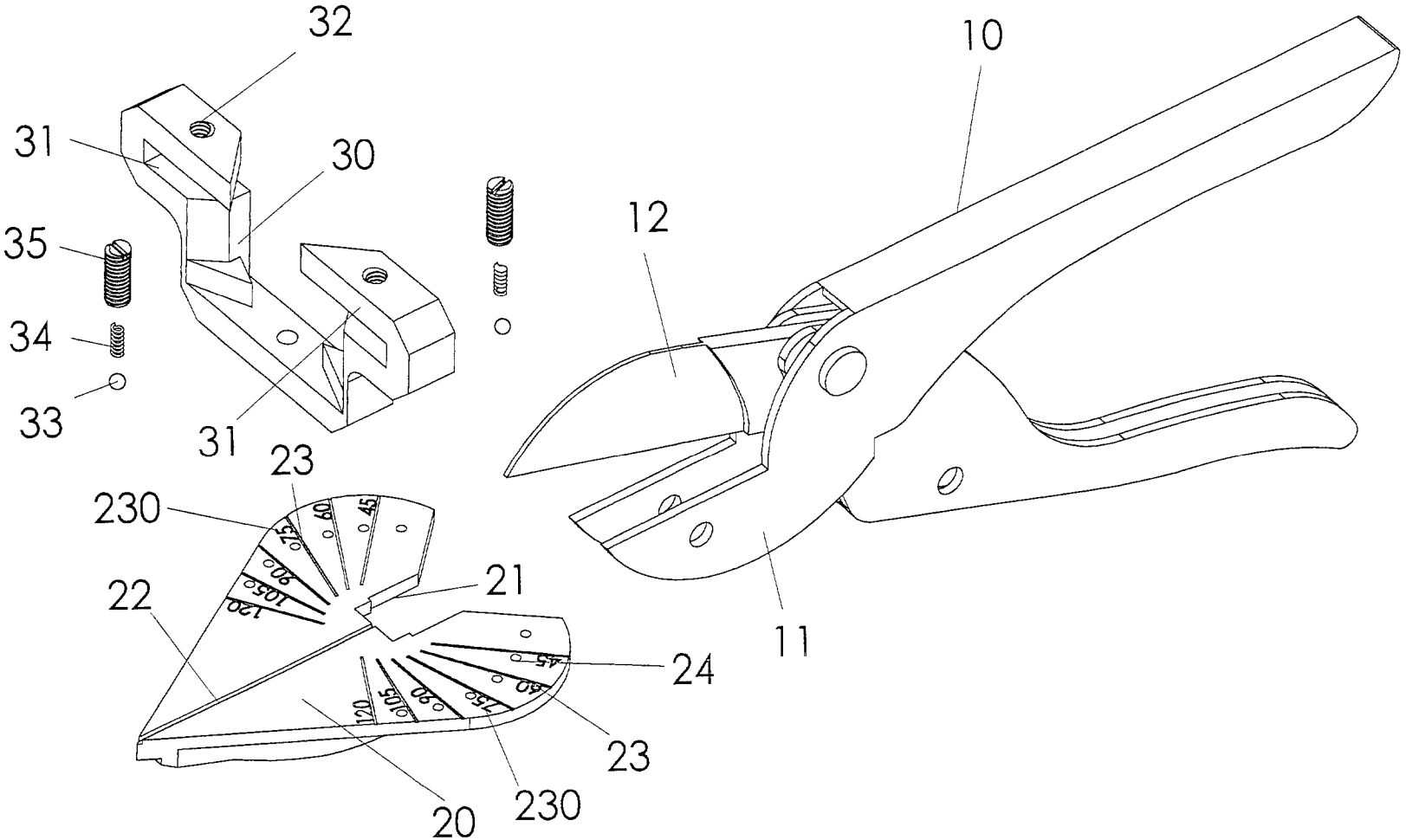
FIG. 1 is an exploded perspective view of a scissors assembly in accordance with the preferred embodiment of the present invention.
Figure 2:
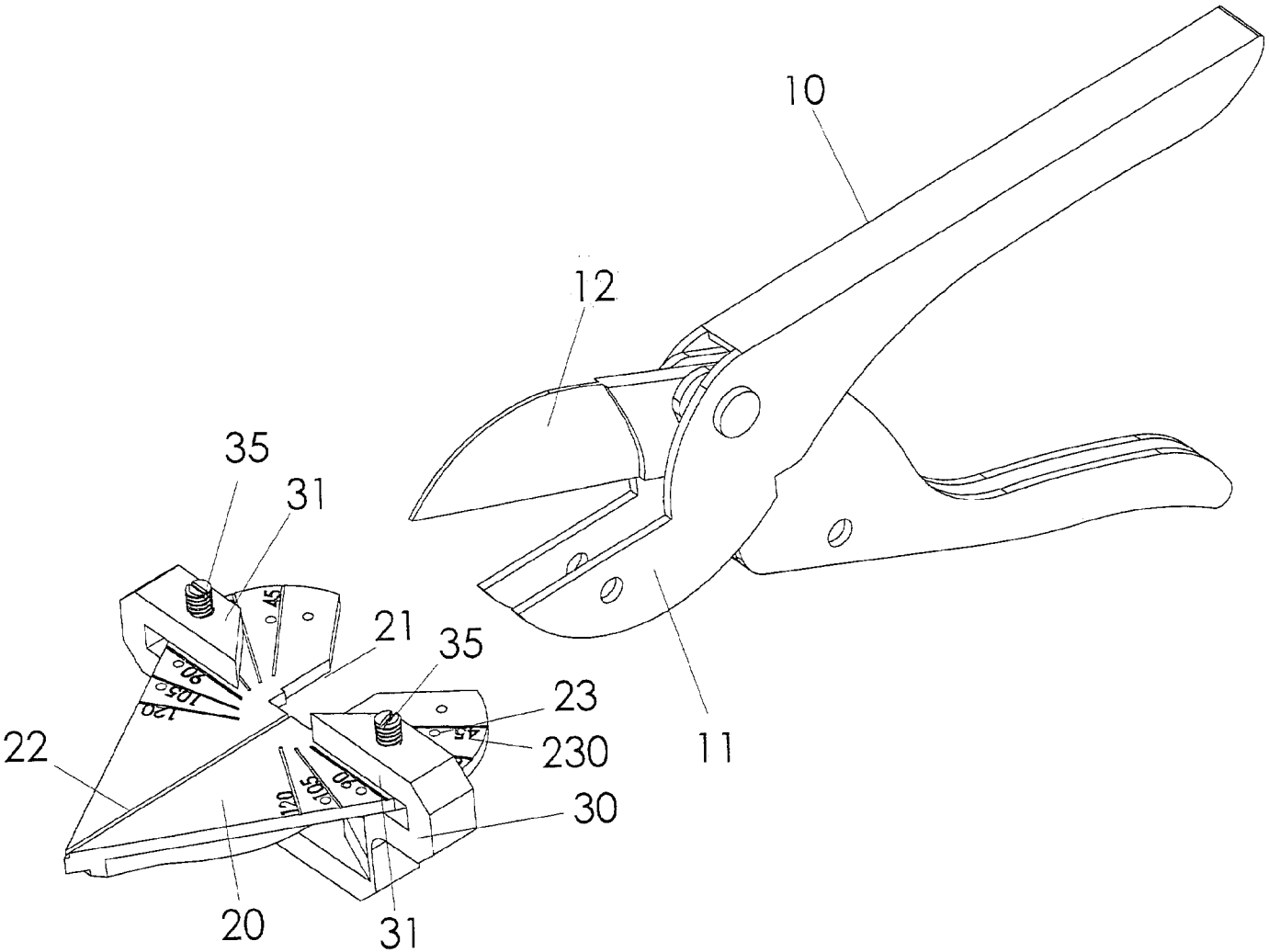
FIG. 2 is a partially exploded, perspective assembly view of the scissors assembly in accordance with the preferred embodiment of the present invention.
Figure 3:
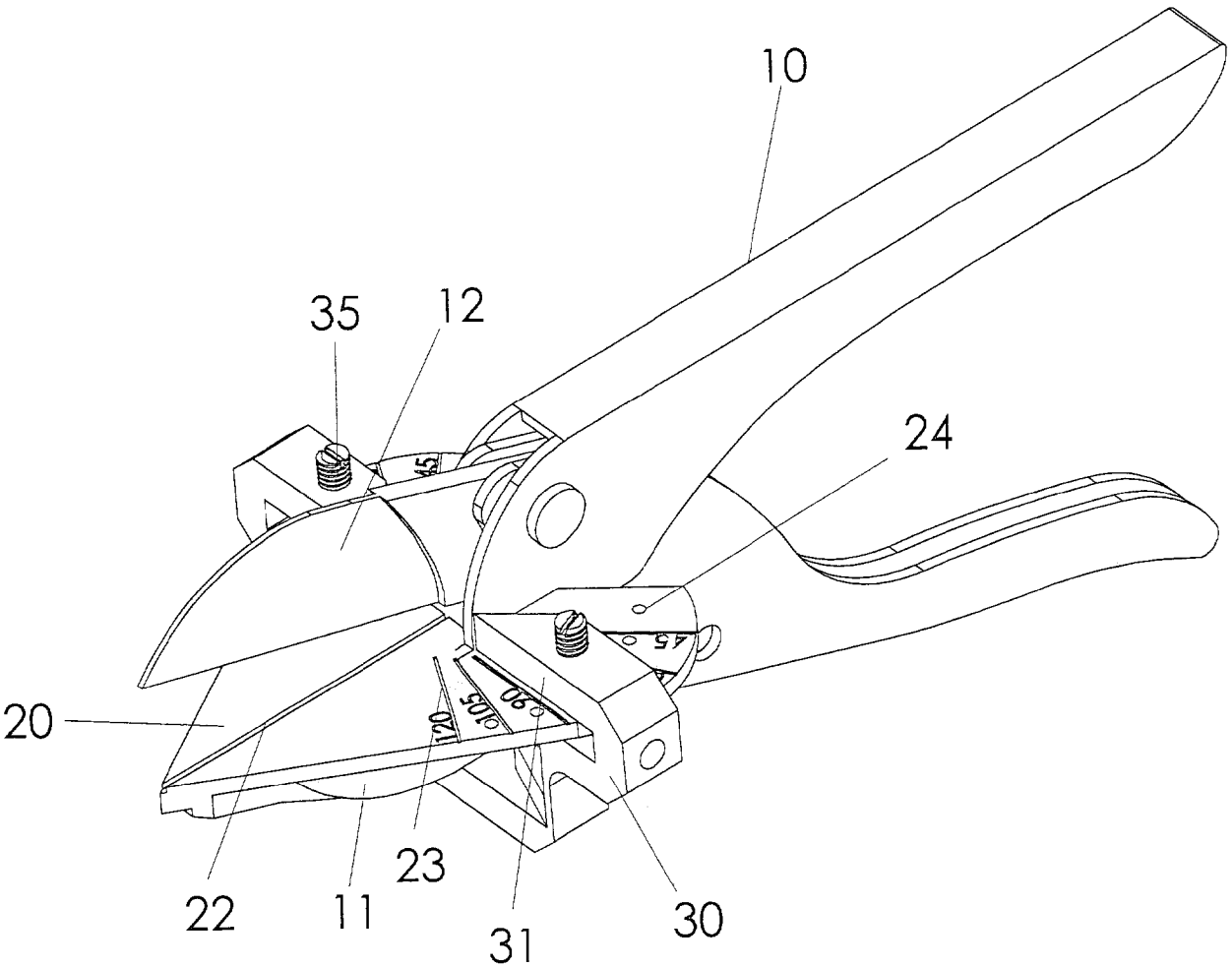
FIG. 3 is a perspective assembly view of the scissors assembly in accordance with the preferred embodiment of the present invention.

Referring to the drawings and initially to FIGS. 1–3, a scissors assembly in accordance with the preferred embodiment of the present invention comprises a main body 10, a jaw plate 20, and an angle adjusting base 30.

The main body 10 includes a support arm 11 and a cutting blade 12 pivotally mounted on the support arm 11.

The jaw plate 20 is secured on the support arm 11 of the main body 10. The jaw plate 20 is formed with an insertion recess 21 for insertion of one end of the main body 10, so that the jaw plate 20 is mounted between the support arm 11 of the main body 10 and the cutting blade 12 of the main body 10. The jaw plate 20 has a top face having a center formed with a recessed center line 22 aligning with the cutting blade 12 of the main body 10, so that the cutting blade 12 of the main body 10 can be inserted into the center line 22 of the jaw plate 20 to cut the material conveniently. The top face of the jaw plate 20 has a plurality of angle scale lines each formed with an angle number 230. The top face of the jaw plate 20 is formed with a plurality of positioning holes 24 each aligning with a respective one of the angle scale lines 23. The distance between each of the positioning holes 24 and the respective angle scale line 23 is arranged such that after the angle adjusting base 30 is positioned, each of the angle scale lines 23 and the respective angle number 230 are exposed outward from the angle adjusting base 30, thereby facilitating the user's identification.

The angle adjusting base 30 is pivotally mounted on the jaw plate 20, so as to adjust the relative angle between the angle adjusting base 30 and the cutting blade 12 of the main body 10. Preferably, the angle adjusting base 30 is pivotally mounted on the center of the jaw plate 20. The angle adjusting base 30 has two sides each provided with an alignment plate 31 aligning with either one of the angle scale lines 23. The alignment plates 31 of the two sides of the angle adjusting base 30 are in line with each other. The alignment plate 31 of each of the two sides of the angle adjusting base 30 is formed with a screw bore 32 for screwing a hollow adjusting screw 35 which is formed with a chamber 350 (see FIG. 4) for receiving an elastic member 34 and a positioning ball 33.

Figure 4:
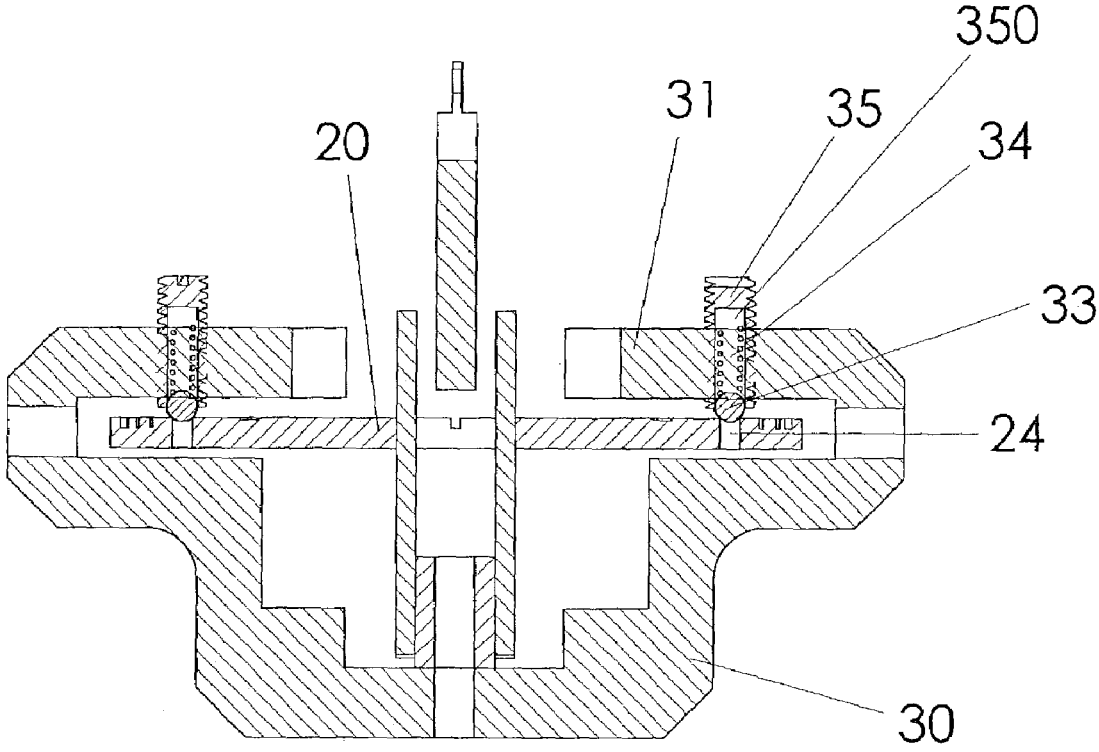
FIG. 4 is a cross-sectional view of the scissors assembly as shown in FIG. 3.

As shown in FIG. 4, the elastic member 34 is urged between the positioning ball 33 and a wall of the chamber 350 of the adjusting screw 35, and the positioning ball 33 is positioned in either one of the positioning holes 24 of the jaw plate 20 by the urging action of the elastic member 34.

Figure 5:
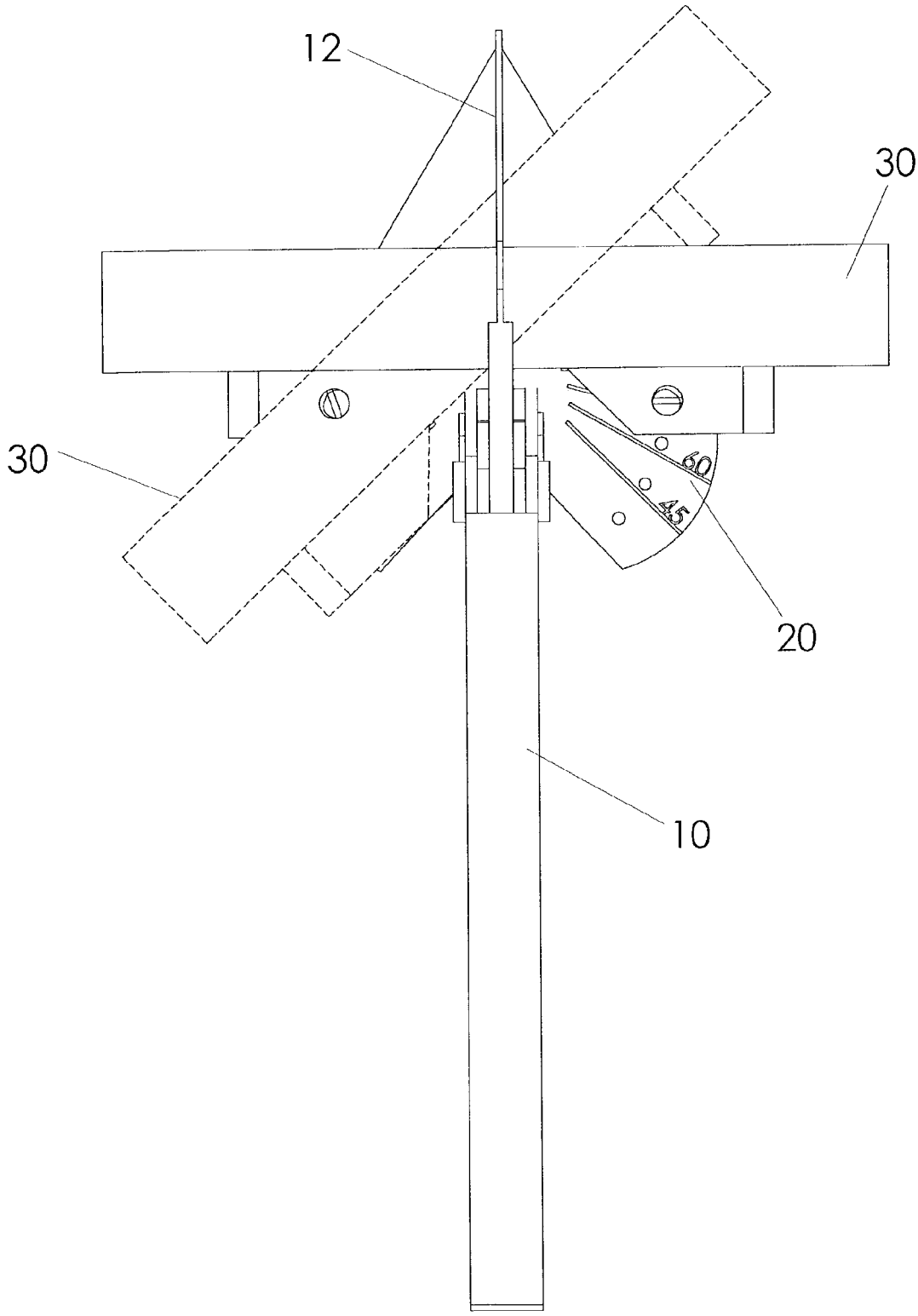
FIG. 5 is a schematic top plan operational view of the scissors assembly taken as shown in FIG. 3.

The distance between the screw bore 32 and an outer edge of the alignment plate 31 of the angle adjusting base 30 is arranged such that after the positioning ball 33 is positioned in either one of the positioning holes 24 of the jaw plate 20, each of the angle scale lines 23 and the respective angle number 230 are exposed outward from the outer edge of the alignment plate 31 of the angle adjusting base 30 as shown in FIG. 5, thereby facilitating the user's identification.

In practice, when the user needs to cut out the angle of a sheet shaped material, the adjusting screw 35 is slightly unscrewed from the screw bore 32 of the angle adjusting base 30, so that the positioning ball 33 is unlocked from either one of the positioning holes 24 of the jaw plate 20. Thus, the angle adjusting base 30 can be rotated on the jaw plate 20 freely, so that the angle adjusting base 30 can be moved to the required angle rapidly. Then, the adjusting screw 35 is screwed into the screw bore 32 of the angle adjusting base 30, so that the positioning ball 33 is locked and positioned in either one of the positioning holes 24 of the jaw plate 20 by the urging action of the elastic member 34, thereby positioning the angle adjusting base 30 on the jaw plate 20 rigidly and stably.

Accordingly, the angle adjusting base 30 can be rotated and positioned on the jaw plate 20 rapidly and conveniently, so that the relative angle between the angle adjusting base 30 and the cutting blade 12 of the main body 10 can be adjusted rapidly and conveniently. Thus, the operation is easy and convenient. In addition, the material is rested on the alignment plates 31 of the two sides of the angle adjusting base 30,so that the material can be cut accurately without incurring errors, thereby enhancing cutting precision. Further, after the positioning ball 33 is positioned in either one of the positioning holes 24 of the jaw plate 20, each of the angle scale lines 23 and the respective angle number 230 are exposed outward from the outer edge of the alignment plate 31 of the angle adjusting base 30 as shown in FIG. 5, thereby facilitating the user's identification. Further, after the positioning ball 33 is positioned in either one of the positioning holes 24 of the jaw plate 20, each of the angle scale lines 23 and the respective angle number 230 are exposed outward from the outer edge of the alignment plate 31 of the angle adjusting base 30 as shown in FIG. 5, thereby facilitating the user's identification.

Figure 6:
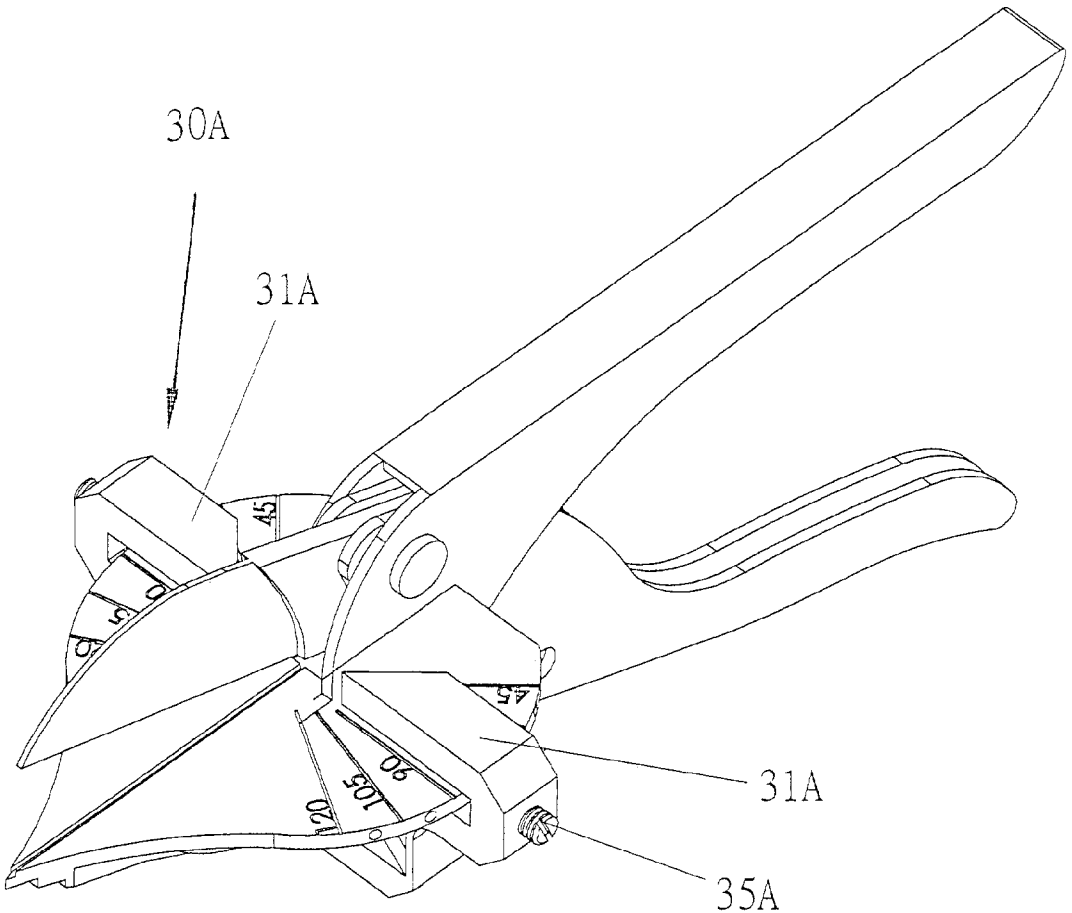
FIG. 6 is a perspective assembly view of the scissors assembly in accordance with another embodiment of the present invention.
Figure 7:
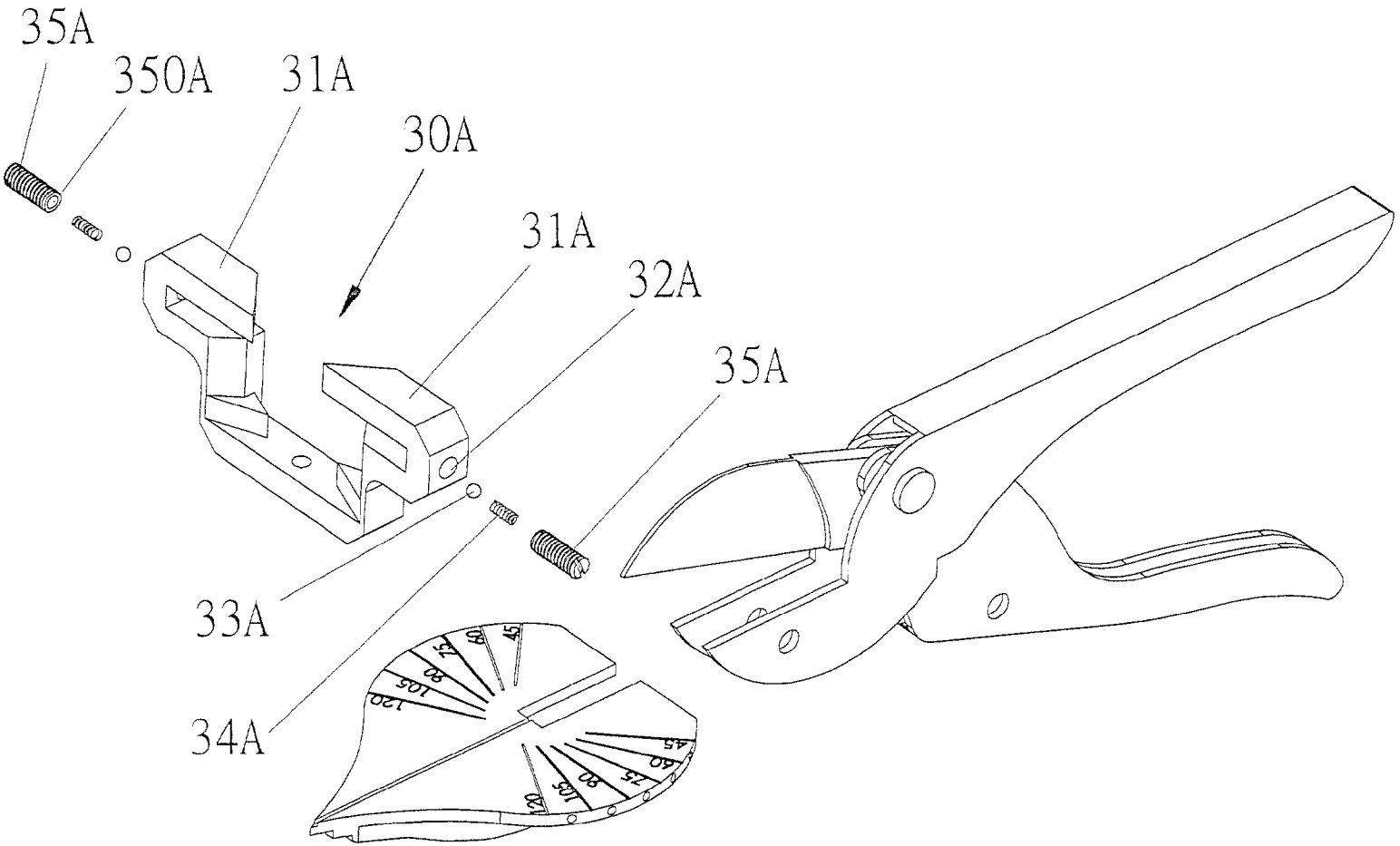
FIG. 7 is an exploded perspective assembly view of the scissors assembly in accordance with another embodiment of the present invention.

Referring to FIGS. 6 and 7, the scissors assembly in accordance with another embodiment of the present invention is shown. Specifically, the alignment plate 31A of each of the two sides of the angle adjusting base 30A has a side plate formed with a screw bore 32A for screwing a hollow adjusting screw 35A which is formed with a chamber 350A (see FIG. 7) for receiving an elastic member 34A and a positioning ball 33A. The periphery of the jaw plate is formed with the plurality of positioning holes 24 each aligning with a respective one of the angle scale lines 23, with the positioning ball 33A being positionable in one of the positioning holes 24 of the jaw plate 20 by the urging action of the elastic member 34A.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A scissors assembly comprising a main body, a jaw plate, and an angle adjusting base, wherein:

the main body includes a support arm and a cutting blade pivotally mounted on the support arm;

the jaw plate is secured on the support arm of the main body and has a plurality of angle scale lines; and the angle adjusting base is pivotally mounted on the jaw plate and has an alignment plate for aligning with one of the angle scale lines, with the angle adjusting base being adjustable positionable and lockable in position relative to the jaw plate, wherein the jaw plate has a top face having a center formed with a recessed center line aligning with the cutting blade of the main body, so that the cutting blade of the main body can be inserted into the center line of the jaw plate, with the jaw plate having a bottom opposite to the top face, with the recessed center line extending from the top face towards the bottom, with the angle adjusting plate having a periphery extending between the top face and the bottom, with the alignment plate of the angle adjusting base having a C-shaped side, with the C-shaped side including a bottom plate extending below the bottom of the jaw plate, with the angle adjusting base pivotally mounted by the bottom plate about an axis, with the bottom plate extending perpendicular to the axis, with the C-shaped side including a side plate extending from the bottom plate parallel to the axis adjacent to the periphery of the jaw plate, with the C-shaped side including a top plate extending above the top face and perpendicular to the axis, with the C-shaped side having an extension located below the jaw plate and below the C-shaped side.

2. The scissors assembly in accordance with claim 1, wherein the angle adjusting base is adjustably positionable and lockable in position relative to the jaw plate by a plurality of positioning holes aligned with a respective one of the angle scale lines, and a member positionable with an urging action in one of the plurality of positioning holes, with the member being received in a bore formed in the angle adjustment base and the plurality of positioning holes formed in the jaw plate, with the bore including an elastic member, with the member being a positioning ball positionable in said one of the plurality of positioning holes by the urging action of the elastic member, with the bore being a screw bore, with a hollow adjusting screw screwed into the screw bore, wherein the hollow adjusting screw is formed with a chamber for receiving the elastic member and the positioning ball.

3. The scissors assembly in accordance with claim 2 with the screw bore formed in the top plate of the C-shaped side.

4. The scissors assembly in accordance with claim 2, wherein the screw bore is formed in the side plate of the alignment plate of the angle adjusting base.

5. The scissors assembly in accordance with claim 2 with the plurality of positioning holes formed in the periphery of the jaw plate.

6. A scissors assembly comprising a main body, a jaw plate, and an angle adjusting base, wherein:

the main body includes a support arm and a cutting blade pivotally mounted on the support arm;

the jaw plate is secured on the support arm of the main body and has a plurality of angle scale lines; and the angle adjusting base is pivotally mounted on the jaw plate and has an alignment plate for aligning with one of the angle scale lines, with the angle adjusting base being adjustably positionable and lockable in position relative to the jaw plate, with the jaw plate having a bottom opposite to a top face including a center formed with a recessed center line aligning with the cutting blade of the main body, so that the cutting blade of the main body can be inserted into the center line of the jaw plate, wherein the angle adjusting base is adjustably positionable and lockable in position relative to the jaw plate by a plurality of positioning holes aligned with a respective one of the angle scale lines and a member positionable with an urging action in one of the plurality of positioning holes, with the plurality of positioning holes formed in the top face of the jaw plate, with the alignment plate of the angle adjusting base having a C-shaped side, with the C-shaped side including a bottom plate extending below the bottom of the jaw plate, with the C-shaped side having an extension located below the jaw plate and below the C-shaped side.

7. The scissors assembly in accordance with claim 6, wherein the angle adjusting base is pivotally mounted on the center of the jaw plate, wherein the center of the jaw plate is aligned with the recessed center line.

8. The scissors assembly in accordance with claim 6, wherein the jaw plate is formed with an insertion recess for insertion of one end of the main body, so that the jaw plate is mounted between the support arm of the main body and the cutting blade of the main body.

9. The scissors assembly in accordance with claim 6 with the angle adjusting base having two sides, with each of the two sides including the alignment plate.

10. The scissors assembly in accordance with claim 9, wherein the alignment plates of the two sides of the angle adjusting base are in line with each other.

11. The scissors assembly in accordance with claim 6 with the member being received in a bore, with the bore including an elastic member, with the member positionable in said one of the plurality of positioning holes by the urging action of the elastic member.

12. The scissors assembly in accordance with claim 11 with the bore being a screw bore, with a hollow adjusting screw screwed into the screw bore, with the hollow adjusting screw containing the elastic member.

13. The scissors assembly in accordance with claim 11 with the bore formed in the angle adjustment base.

14. The scissors assembly in accordance with claim 11 with the member being a positioning ball.

15. The scissors assembly in accordance with claim 14 with the bore being a screw bore, with a hollow adjusting screw screwed into the screw bore, with the hollow adjusting screw containing the elastic member.

16. The scissors assembly in accordance with claim 15, wherein the hollow adjusting screw is formed with a chamber for receiving the elastic member and the positioning ball.

17. The scissors assembly in accordance with claim 16, wherein the elastic member is urged between the positioning ball and a wall of the chamber of the hollow adjusting screw.

18. The scissors assembly in accordance with claim 15, wherein each of the angle scale lines is formed with an angle number.

19. The scissors assembly in accordance with claim 18, wherein the distance between each of the positioning holes and the respective angle scale line is arranged such that after the angle adjusting base is positioned, each of the angle scale lines and the respective angle number are exposed outward from the angle adjusting base.

20. The scissors assembly in accordance with claim 18, wherein the distance between the screw bore and an outer edge of the alignment plate of the angle adjusting base is arranged such that after the positioning ball is positioned in either one of the positioning holes of the jaw plate, each of the angle scale lines and the respective angle number are exposed outward from the outer edge of the alignment plate of the angle adjusting base.

* * * * *